US007223143B1

(12) United States Patent
Martin

(10) Patent No.: US 7,223,143 B1
(45) Date of Patent: May 29, 2007

(54) INFLATABLE, SELF-PROPELLED LIFE VEST

(76) Inventor: Jerry L. Martin, 6387 Dove St., Norfolk, VA (US) 23513

( * ) Notice: Subject to any disclaimer, the term of this patent is extended or adjusted under 35 U.S.C. 154(b) by 0 days.

(21) Appl. No.: 11/332,211

(22) Filed: Jan. 17, 2006

(51) Int. Cl.
*B63C 9/00* (2006.01)

(52) U.S. Cl. ..... 441/80

(58) Field of Classification Search ..... 441/80, 441/117

See application file for complete search history.

(56) References Cited

U.S. PATENT DOCUMENTS 1,259,201 A 3/1918 Barrringer
2,312,976 A 3/1943 Pels
5,152,706 A 10/1992 Fister
5,619,948 A * 4/1997 Keyvani ..... 114/315
5,743,772 A 4/1998 Assawah et al.
5,947,782 A * 9/1999 Siladke et al. ..... 441/129
6,837,764 B2 1/2005 Bradley

* cited by examiner

*Primary Examiner*—Stephen Avila
(74) *Attorney, Agent, or Firm*—Shlesinger, Arkwright & Garvey LLP

(57) ABSTRACT

Self-propelled life vest for assisting a swimmer in water includes an inflatable body, the body being configured for being worn on a torso of a swimmer. An upper connector is provided and configured for connecting the body to an upper portion of a swimmer, in use. A lower connector is configured for connecting to a lower portion of a swimmer, in use. A propulsion unit on the vest is sufficiently strong for propelling a swimmer through water, in use. A power is operatively connected with the propulsion unit for powering the propulsion unit. An inflation control is provided on the body and operatively connects with the inflation device for inflating and deflating the inflation device, in use. A propulsion unit housing prevents the swimmer from contacting the propulsion unit, and directs inflow and outflow of propelled water, in use, for assisting in moving the swimmer in the desired direction.

9 Claims, 3 Drawing Sheets

INFLATABLE, SELF-PROPELLED LIFE VEST

FIELD OF THE INVENTION

The invention relates to life vests. More particularly, the invention relates to self-propelled life vests. Even more particularly the invention relates to a motor-driven, self-propelled inflatable swimming vest or life vest, particularly suited for saving the lives of swimmers who are handicapped or who have one or more missing limbs.

BACKGROUND OF THE INVENTION

Life vests are known.

There have been previous attempts at providing life vests for disabled people.

There have likewise been previous attempts to provide life vests and other floatation devices which include propelling devices of varying types.

Known U.S. patents include:

U.S. Pat. No. 1,259,201 to Barringer;

U.S. Pat. No. 5,743,772 to Assawah et al.;

U.S. Pat. No. 2,312,976 to Pels;

U.S. Pat. No. 5,152,706 to Fister;

U.S. Pat. No. 6,837,764 to Bradley; and

U.S. Pat. No. 5,947,782 to Siladke et al.

None of the known devices have proven satisfactory.

It may be seen that there is a need for an improved self-propelled life vest which overcomes the drawbacks of known devices.

OBJECTS AND SUMMARY OF THE INVENTION

It is an object of the invention to provide a self-propelled life vest which overcomes the drawbacks of the prior art.

Another object of the invention is to provide a self-propelled life vest which saves time and lives, thanks to the vest speeding up the rescue of swimmers who are in trouble.

A further object of the invention is to provide a self-propelled life vest which assists lifeguards in bringing swimmers back to shore more quickly who have been rescued.

Yet another object of the invention to provide a self-propelled life vest which can be used by children as well as adults to have fun.

It is another object of the invention to provide a self-propelled life vest which can be used to rescue handicapped users who have fallen into or otherwise ended up in the water, such as when a boat sinks.

A further object of the invention is to provide a self-propelled life vest which is sufficiently powerful to assist swimmers, and which includes one or more speeds depending on the needs of the user or the demands of the situation.

In sum, the invention includes a self-propelled life vest for assisting a swimmer in water. The life vest includes an inflatable body, the body being configured for being worn on a torso of a swimmer. An upper connector is provided and configured for connecting the body to an upper portion of a swimmer, in use. A lower connector is configured for connecting to a lower portion of a swimmer, in use. A propulsion unit on the vest is sufficiently strong for propelling a swimmer through water, in use. A power is operatively connected with the propulsion unit for powering the propulsion unit.

An inflation control is provided on the body and operatively connects with the inflation device for inflating and deflating the inflation device, in use. A propulsion unit housing prevents the swimmer from contacting the propulsion unit, and directs inflow and outflow of propelled water, in use, for assisting in moving the swimmer in the desired direction.

The invention may further include one or more controls for inflating and deflating the life vest.

The invention likewise includes one or more controls for turning on and off the propulsion device and/or varying the speed of propulsion.

Relative terms such as up, down, front, rear, left, and right are for convenience only and are not intended to be limiting.

DETAILED DESCRIPTION OF THE INVENTION

Figure 1:
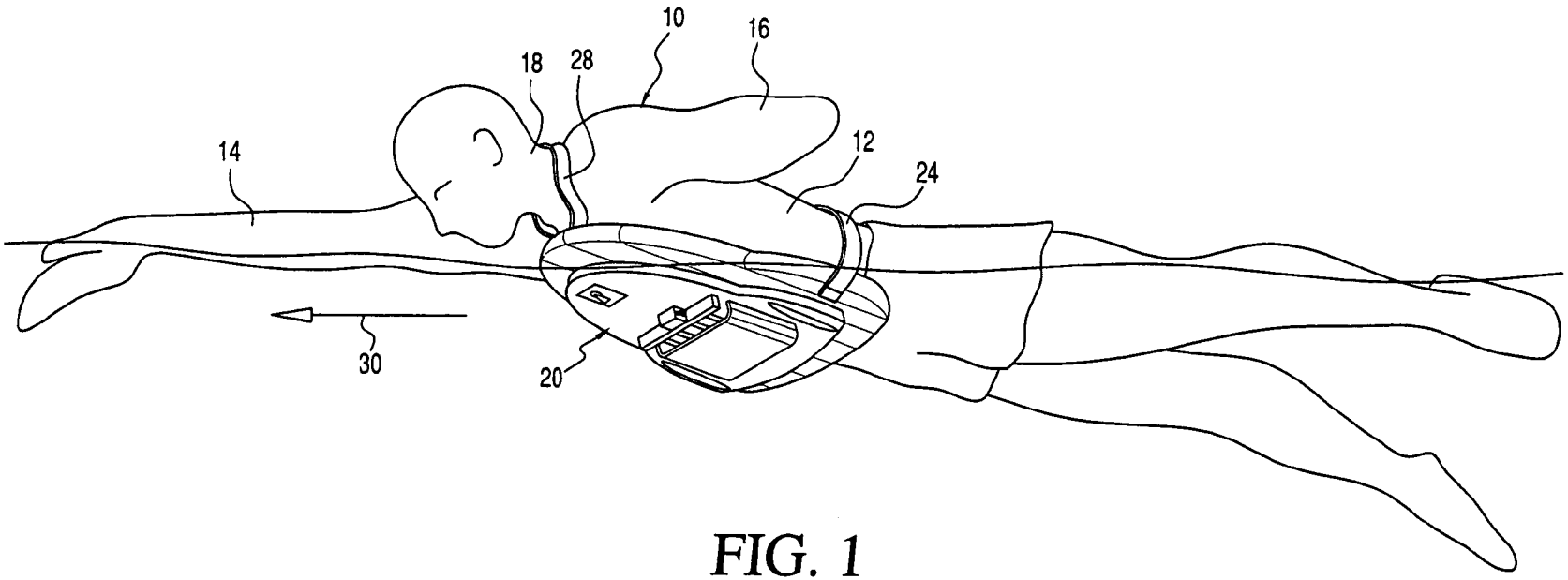
FIG. 1 illustrates an embodiment of a self-propelled life vest according to the invention, in use, propelling a handicapped swimmer through the water.

FIGS. 1–4 illustrate an embodiment of the invention, in use, attached to a swimmer 10.

Swimmer 10 is shown including a torso 12, a right arm 14, and a left arm 16, shown here as a partially amputated left arm, as an example of the type of handicap which swimmer 10 may have and which swimmer 10 is being assisted by a life vest 20 according to the invention.

Life vest 20 may include a lower strap 24 configured for detachably attaching to torso 12, and an upper strap 28 for detachably attaching to an upper portion of swimmer 10, such as around a neck 18 of swimmer 10.

In use, self-propelled life vest 20 may move swimmer 10 in a forward direction of travel 30, as shown.

Lower connector or strap 24 may include a quick-attach connector 34, such as the illustrated female connector 34, or a part of a hook-and-loop fastener, such as VELCRO® brand fasteners, as will be readily appreciated.

Upper strap 28 may include a male connector 38 for quickly attaching and detaching from female connector 34 or a mating part of a hook-and-loop fastener. In addition to or alternatively, lower strap 24 may include a flexible or adjustable strap material 42 to assist in attaching life vest 20 to different sizes of users.

Life vest 20 may include a body 50 including a rear 54 configured for being secured adjacent the front of torso of the swimmer's torso 12. A forward portion 56 may typically be provided at an upper portion of the swimmer's body, in use. Body 50 may be an inflatable body 50, as shown, for assisting in keeping swimmer 10 afloat.

A front 58 of body 50 may typically be facing away from swimmer 10, in use.

Figure 3:
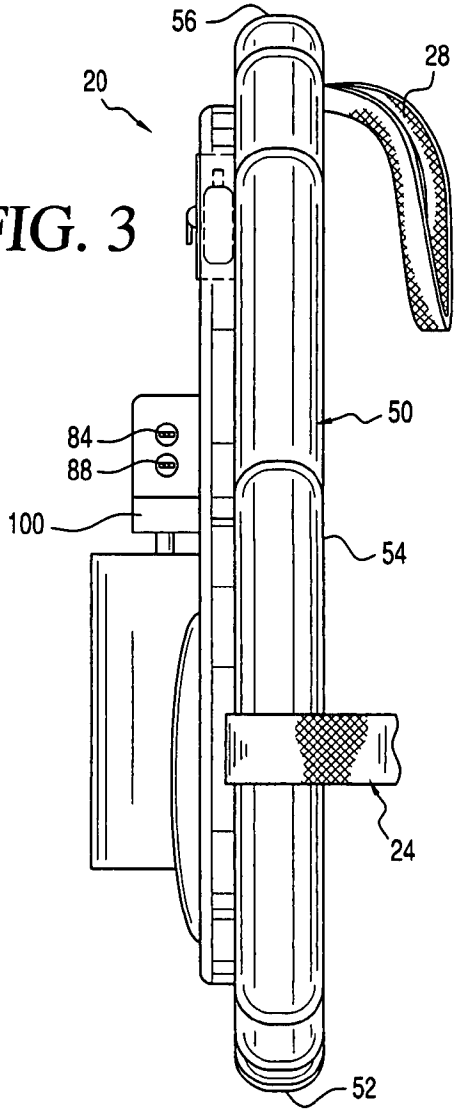
FIG. 3 is a side view of FIG. 2 illustrating the self-propelled life vest according to the invention.
Figure 2:
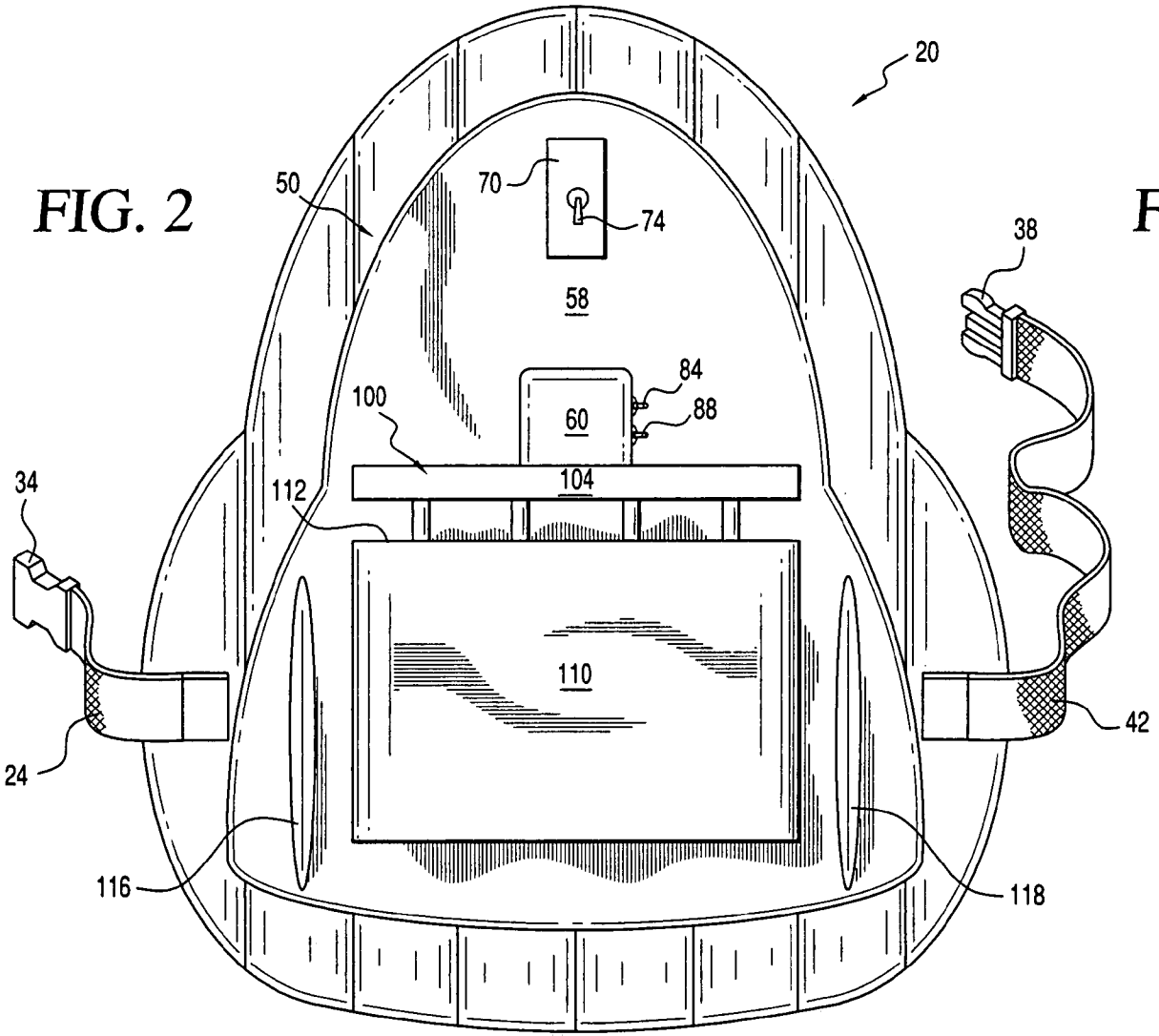
FIG. 2 is an enlarged front view of the self-propelled life vest of the embodiment of FIG. 1.

A bottom region or portion 52, as shown in FIG. 3, would typically be located at a lower portion of swimmer 10, in use.

A housing 60, such as a motor housing, may be provided on front 58 of life vest 20.

A control, such as a control unit 70, which may include electrical or electromechanical controls, as well as a power source, such as batteries, in the case where electricity provides the power for powering vest 20, may be provided on front 58. Control unit 70 may include an inflate/deflate switch 74 for inflating and deflating the life vest 20, in use. Life vest 20 is shown inflated in FIGS. 1–4; i.e., in its typical use position or state. The use of a self-inflating device assists all users, and may be particularly useful for handicapped users, at least for handicapped users who may have difficulty inflating a conventional life vest, for example. The inflation unit 70 is useful in the case of non-handicapped swimmers 10, as any swimmer who has fallen in the water, or who is otherwise attempting to reach shore, may be nervous and may have a more difficult time inflating life vest 20, than in the case where swimmer 10 is calm.

One or more switches 84 and 88 may be provided for controlling the speed of a propulsion drive 100. Switch 84 may be a low speed switch, for example, and switch 88 may be a high speed switch.

A housing 104 may be provided for covering gearing and driving mechanism 100 for distributing power to a propulsion unit 114. A propulsion housing 110 having a front 112 may be provided for enclosing propulsion unit 114. Propulsion housing 110 may be configured sufficiently open so that water to be propelled may enter propulsion housing 110, and be accelerated and propelled out of propulsion housing 110 by propulsion unit 114, for causing vest 20 and swimmer 10 to move through the water in direction 30, in use, as will be readily appreciated.

One or more guide fins 116 and 118 may be provided for causing or assisting in causing life vest 20 to move in forward direction 30, in use.

Figure 4:
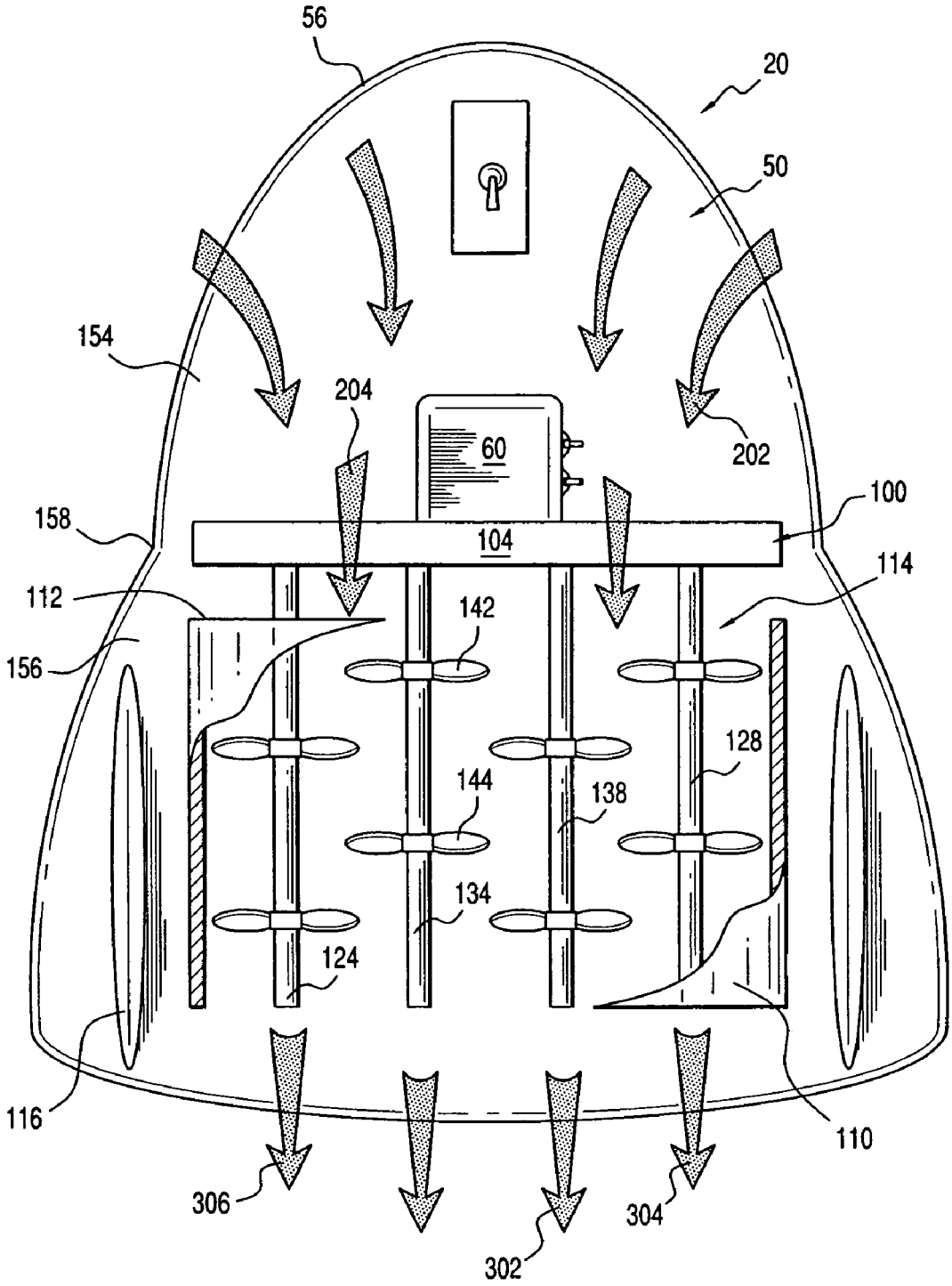
FIG. 4 is a partially broken away front view similar to the view of FIG. 2 illustrating the invention.

In the case where propulsion unit 114 includes driven propellers, propulsion unit 114 may include first, outer propeller shafts 124 and 128, as well as second, inner propeller shafts 134 and 138, as shown in FIG. 4. Each one of propeller shafts 124, 128, 134, and 138 may include one or more propellers 142 and 144, as shown. Two propellers 142 and 144 are shown on propeller shaft 134 for illustrative purposes, and are not intended to be limiting.

In use, swimmer 10 who is in the water, actuates inflate/deflate switch 74, and inflates body 50 of vest 20.

Then, as desired, swimmer 10 actuates one or both of switches 84 and 88 in order to drive one or more of the propellers of propulsion unit 114.

Assuming that swimmer 10 wishes to first propel vest 20 at a first, low speed, for example, the user would flip switch 84 and cause gearing or drive 104 to drive inner propeller shafts 134 and 138 for causing associated propellers 142 and 144 of each of those two propeller shafts to rotate.

As will be readily appreciated, water will be drawn inwardly into propulsion unit 110, such water being indicated by arrows 202 and 204. Propellers 142 and 144, driven by rotating shafts 132 and 138 will cause inwardly drawn water 202, 204 to be forced out of propulsion unit 114, such as shown by arrows 302 representing propelled water. Swimmer 10 will thus be moved away from the direction of arrow 302 forwardly in the water in direction 30.

If the user then decides that he or she would like to be propelled at a greater rate of speed, user 10 may switch high speed switch 88 into its on position. In that manner, drive unit 104 may actuate second, outer propeller shafts 124 and 128, thus driving each of their respective propellers. In that manner, water drawn inwardly as shown by arrows 202 and 204 will be propelled as shown by exiting arrows 304 and 306, in addition to exiting water arrows 302, and swimmer 10 will be propelled forwardly in direction 30 at a greater rate of speed.

It should be appreciated that each of the shafts 124 and 134, for example, may be driven at the same rate of speed. Thanks to the driving of twice as many propeller shafts and twice as many propellers, as shown in the illustrative embodiment of FIG. 4, even though the propellers are being driven at the same rate of speed, thanks to the driving of additional propellers at high speed versus at low speed, more water is being propelled, and the greater flow rate will cause the user to move forwardly at a greater rate of speed, as will be readily appreciated by a person having ordinary skill in the art.

It is likewise contemplated that one or more of the propellers 142 and 144 be driven at different rates of speed.

It is further contemplated that other drive units and propulsion units may be provided in addition to, or instead of, the illustrated motor-driven, electrically powered, and propeller-driven drive and propulsion units.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A self-propelled life vest for assisting a swimmer in water, comprising:

a) a body, the body being configured for being worn on a torso of a swimmer;

b) an upper connector configured for connecting the body to an upper portion of a swimmer, in use;

c) a lower connector configured for connecting to a lower portion of a swimmer, in use;

d) a propulsion unit provided on the body, the propulsion unit being sufficiently strong for propelling a swimmer through water, in use;

e) a power supply provided on the body and operatively connected with the propulsion unit for powering the propulsion unit;

f) an inflation device provided on the body, the inflation device being inflatable and deflatable;

g) an inflation control provided on the body and operatively connected with the inflation device for inflating and deflating the inflation device, in use;

h) a housing provided on the body, the housing being provided adjacent the propulsion unit for restricting the swimmer from contacting the propulsion unit, and for directing an inflow and outflow of propelled water, in use;

i) the propulsion unit including at least a first propeller and a second propeller; and j) the propulsion unit being configured for driving the first propeller and the second propeller independently.

2. Self-propelled life vest as in claim 1, wherein:

a) the housing covering the propulsion unit is configured for substantially completely covering the propulsion unit.

3. Self-propelled life vest as in claim 1, wherein:

a) the propulsion unit is configured for driving the first propeller and the second propeller independently and at substantially the same rate of speed.

4. Self-propelled life vest as in claim 1, wherein:

a) the lower connector is configured for being secured around a waist of the swimmer, in use.

5. Self-propelled life vest as in claim 4, wherein:

a) the upper connector is configured for being secured to a neck of a swimmer, in use.

6. Self-propelled life vest as in claim 1, wherein:

a) the upper connector is configured for being secured to a neck of a swimmer, in use.

7. Self-propelled life vest as in claim 1, wherein:

a) the propulsion unit includes an electric motor.

8. A self-propelled life vest for assisting a swimmer in water, comprising:

a) a body, the body being configured for being worn on a torso of a swimmer;

b) an upper connector configured for connecting the body to an upper portion of a swimmer, in use;

c) a lower connector configured for connecting to a lower portion of a swimmer, in use;

d) a propulsion unit provided on the body, the propulsion unit being sufficiently strong for propelling a swimmer through water, in use;

e) a power supply provided on the body and operatively connected with the propulsion unit for powering the propulsion unit;

f) an inflation device provided on the body, the inflation device being inflatable and deflatable;

g) an inflation control provided on the body and operatively connected with the inflation device for inflating and deflating the inflation device, in use;

h) a housing provided on the body, the housing being provided adjacent the propulsion unit for restricting the swimmer from contacting the propulsion unit, and for directing an inflow and outflow of propelled water, in use;

i) the propulsion unit including a first propeller and a second propeller;

j) the control device causing the first propeller to operate for propelling the life vest at a first speed; and k) the control device causing the first propeller and the second propeller to operate for propelling the life vest at a second speed.

9. A self-propelled life vest for assisting a swimmer in water, comprising:

a) a body, the body being configured for being worn on a torso of a swimmer;

b) an upper connector configured for connecting the body to an upper portion of a swimmer, in use;

c) a lower connector configured for connecting to a lower portion of a swimmer, in use;

d) a propulsion unit provided on the body, the propulsion unit being sufficiently strong for propelling a swimmer through water, in use;

e) a power supply provided on the body and operatively connected with the propulsion unit for powering the propulsion unit;

f) an inflation device provided on the body, the inflation device being inflatable and deflatable;

g) an inflation control provided on the body and operatively connected with the inflation device for inflating and deflating the inflation device, in use;

h) a housing provided on the body, the housing being provided adjacent the propulsion unit for restricting the swimmer from contacting the propulsion unit, and for directing an inflow and outflow of propelled water, in use; and i) a fin being provided for directing the flow of water as the life vest is moved forwardly, in use.

* * * * *